US010704411B2

(12) United States Patent
Mielke

(10) Patent No.: US 10,704,411 B2
(45) Date of Patent: Jul. 7, 2020

(54) VARIABLE VANE ACTUATION SYSTEM FOR A TURBO MACHINE

(71) Applicant: General Electric Company, Schenectady, NY (US)

(72) Inventor: Mark Joseph Mielke, Blanchester, OH (US)

(73) Assignee: General Electric Company, Schenectady, NY (US)

( * ) Notice: Subject to any disclaimer, the term of this patent is extended or adjusted under 35 U.S.C. 154(b) by 128 days.

(21) Appl. No.: 16/054,248

(22) Filed: Aug. 3, 2018

(65) Prior Publication Data

US 2020/0040759 A1 Feb. 6, 2020

(51) Int. Cl.
*F01D 17/16* (2006.01)
*F04D 29/56* (2006.01)

(52) U.S. Cl.
CPC ..... *F01D 17/16* (2013.01); *F04D 29/563* (2013.01); *F05D 2220/32* (2013.01); *F05D 2240/128* (2013.01); *F05D 2260/57* (2013.01)

(58) Field of Classification Search
CPC .... F01D 17/16; F04D 29/563; F05D 2220/32; F05D 2240/128; F05D 2260/57
See application file for complete search history.

(56) References Cited

U.S. PATENT DOCUMENTS 2,778,564 A 1/1957 Halford et al.
3,318,513 A 5/1967 Johnson
3,392,909 A 7/1968 Turner
4,177,681 A 12/1979 Wess
4,755,104 A 7/1988 Castro et al.
4,844,695 A 7/1989 Banks et al.
4,950,129 A 8/1990 Patel et al.
5,795,128 A 8/1998 Eichstadt
5,993,152 A 11/1999 Schilling
6,722,845 B2 * 4/2004 Chard ..... F01D 17/16 415/150
6,769,868 B2 8/2004 Harrold
6,794,766 B2 9/2004 Wickert et al.
7,520,716 B2 4/2009 Tacconelli et al.
7,762,081 B2 7/2010 Williams
7,922,445 B1 4/2011 Pankey et al.
8,235,655 B1 8/2012 Pankey et al.
8,690,521 B2 4/2014 Colotte et al.
8,740,547 B2 6/2014 Colotte et al.
8,915,703 B2 12/2014 Mohammed
9,068,470 B2 6/2015 Mills et al.
9,151,178 B2 10/2015 Holchin et al.
9,429,169 B2 8/2016 Bouru et al.
9,777,641 B2 * 10/2017 Kay ..... F01D 17/162
2008/0056904 A1 3/2008 Somanath et al.
2009/0097962 A1 4/2009 Williams
2011/0016876 A1 1/2011 Cataldi et al.
(Continued)

*Primary Examiner* — Igor Kershteyn
(74) *Attorney, Agent, or Firm* — Hanley, Flight and Zimmerman, LLC

(57) ABSTRACT

A system for operating a turbo machine is generally provided, the system including a variable vane assembly including a first plurality of vanes coupled together by a first unison member and a second plurality of vanes coupled together by a second unison member. An actuation system is coupled to each of the first unison member and the second unison member and a solenoid actuator is coupled to the variable vane assembly and the actuation system.

20 Claims, 5 Drawing Sheets

(56) References Cited

U.S. PATENT DOCUMENTS

| | | | | |
|---|---|---|---|---|
| 2014/0064910 | A1* | 3/2014 | Velampati | F01D 17/162 415/1 |
| 2015/0198257 | A1 | 7/2015 | Kelm et al. | |
| 2016/0230677 | A1* | 8/2016 | Feulner | F04D 27/0246 |
| 2016/0238013 | A1 | 8/2016 | Weigl et al. | |
| 2017/0159470 | A1 | 6/2017 | Albers et al. | |
| 2017/0268375 | A1 | 9/2017 | Osborne et al. | |
| 2017/0276013 | A1* | 9/2017 | Suciu | F01D 17/162 |
| 2017/0276018 | A1 | 9/2017 | Bifulco et al. | |
| 2017/0276148 | A1* | 9/2017 | Suciu | F01D 9/042 |
| 2018/0156226 | A1* | 6/2018 | Chapman | F04D 27/002 |

* cited by examiner

VARIABLE VANE ACTUATION SYSTEM FOR A TURBO MACHINE

FIELD

The present subject matter relates generally to airfoil actuation systems for turbo machines.

BACKGROUND

Turbo machines, such as gas turbine engines, may include an actuation system coupled to a plurality of stages of vane airfoils via a synchronization or unison ring. The actuation system operates along a linear direction to rotate an angle of the plurality of stages of vanes simultaneously. The actuation system generally moves according to a predetermined schedule based on changes in engine operating mode, such as to improve operability or performance of the turbo machine at various operating modes.

Known variable vane assemblies include an actuation system coupled to a plurality of unison rings corresponding to a plurality of axially separated stages of the turbo machine. Each unison ring is coupled to the plurality of vanes at each stage such that linear movement of the actuation system results in rotation of the vanes at each stage.

However, coupling the actuation system to the plurality of vanes at via the unison rings results in uniform movement of all stages of variable vanes. For example, the kinematics relationship between the actuation system and the motion of the variable vanes is a continuous uniform function (e.g. from linear to sinusoidal curvature), which does not enable localized and abrupt angular orientation variations.

This therefore limits the extent to which the actuation system and variable vanes may improve operability or performance of the turbo machine. Additionally, the uniform movement of all stages may adversely affect turbo machine operability or performance by adversely adjusting a first stage to positively adjust a second stage, or vice versa.

As such, there is a need for a variable vane system for a turbo machine that improves operability or performance of the turbo machine. Additionally, or alternatively, there is a need for a variable vane system that mitigates adverse effects due to changes at a first stage relative to changes at a second stage.

BRIEF DESCRIPTION

Aspects and advantages of the invention will be set forth in part in the following description, or may be obvious from the description, or may be learned through practice of the invention.

The present disclosure is directed to a system for operating a turbo machine. The system includes a variable vane assembly including a first plurality of vanes coupled together by a first unison member and a second plurality of vanes coupled together by a second unison member. An actuation system is coupled to each of the first unison member and the second unison member and a solenoid actuator is coupled to the variable vane assembly and the actuation system.

In one embodiment, the solenoid actuator is coupled to one or more of the unison members of the variable vane assembly.

In various embodiments, the actuation system includes a coupling member in which the coupling member is coupled to each of the unison members. In one embodiment, the solenoid actuator is coupled to the coupling member of the actuation system.

In another embodiment, the solenoid actuator is coupled to the first unison member of the variable vane assembly.

In one embodiment, the solenoid actuator defines a two-position solenoid actuator.

In another embodiment, the solenoid actuator defines a proportional solenoid actuator.

In still another embodiment, the first plurality of vanes defines an upstream-most stage of a compressor section or a turbine section. In another embodiment, the first plurality of vanes defines an inlet guide vane of the compressor section or the turbine section. In still another embodiment, the first plurality of vanes defines an inlet guide vane of a high pressure compressor of the compressor section.

In various embodiments, the system further includes a controller including one or more processors and one or more memory devices. The memory device stores instructions that perform operations when executed. The operations include displacing the first plurality of vanes from a first rotational angle corresponding to a first position of the solenoid actuator to a second rotational angle corresponding to a second position of the solenoid actuator independent of movement from the actuation system. In one embodiment, the operations include offsetting a change in rotational angle at the first plurality of vanes from the actuation system via displacing the solenoid actuator. In another embodiment, the operations further include displacing the first plurality of vanes and the second plurality of vanes via the actuation system. In still another embodiment, the operations further include adjusting the rotational angle of the plurality of vanes via the solenoid actuator at one or more operating conditions of the turbo machine between zero revolutions per minute and maximum steady state operating condition.

Another aspect of the present disclosure is directed to a turbo machine engine including a compressor section, a turbine section, a variable vane assembly including a first plurality of vanes coupled together by a first unison member and a second plurality of vanes coupled together by a second unison member, an actuation system coupled to each of the first unison member and the second unison member; and a solenoid actuator coupled to the variable vane assembly and the actuation system.

In one embodiment, the solenoid actuator is coupled to one or more of the unison members of the variable vane assembly.

In various embodiments, the actuation system includes a coupling member, wherein the coupling member is coupled to each of the unison members. In one embodiment, the solenoid actuator is coupled to the coupling member of the actuation system.

In one embodiment, the solenoid actuator is coupled to the first unison member of the variable vane assembly.

In another embodiment, the solenoid actuator defines a two-position solenoid actuator.

In still another embodiment, the solenoid actuator defines a proportional solenoid actuator.

In yet another embodiment, the variable vane assembly, the actuation system and the solenoid actuator are coupled to the compressor section or a fan section of the turbo machine.

In still yet another embodiment, the variable vane assembly, the actuation system, and the solenoid actuator are coupled to the turbine section.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
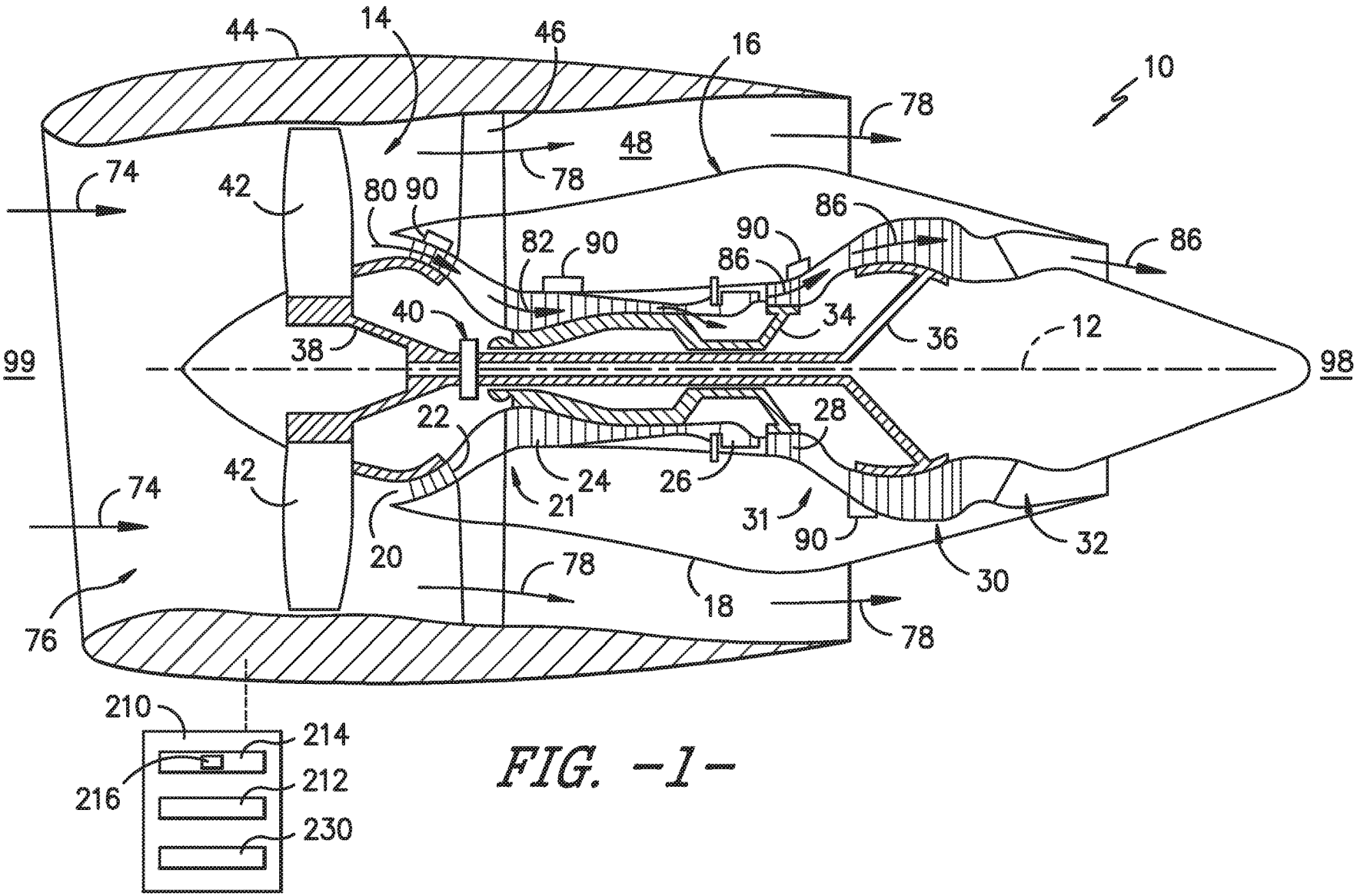
FIG. 1 is a schematic cross sectional view of an exemplary turbo machine according to an aspect of the present disclosure.
Figure 2A:
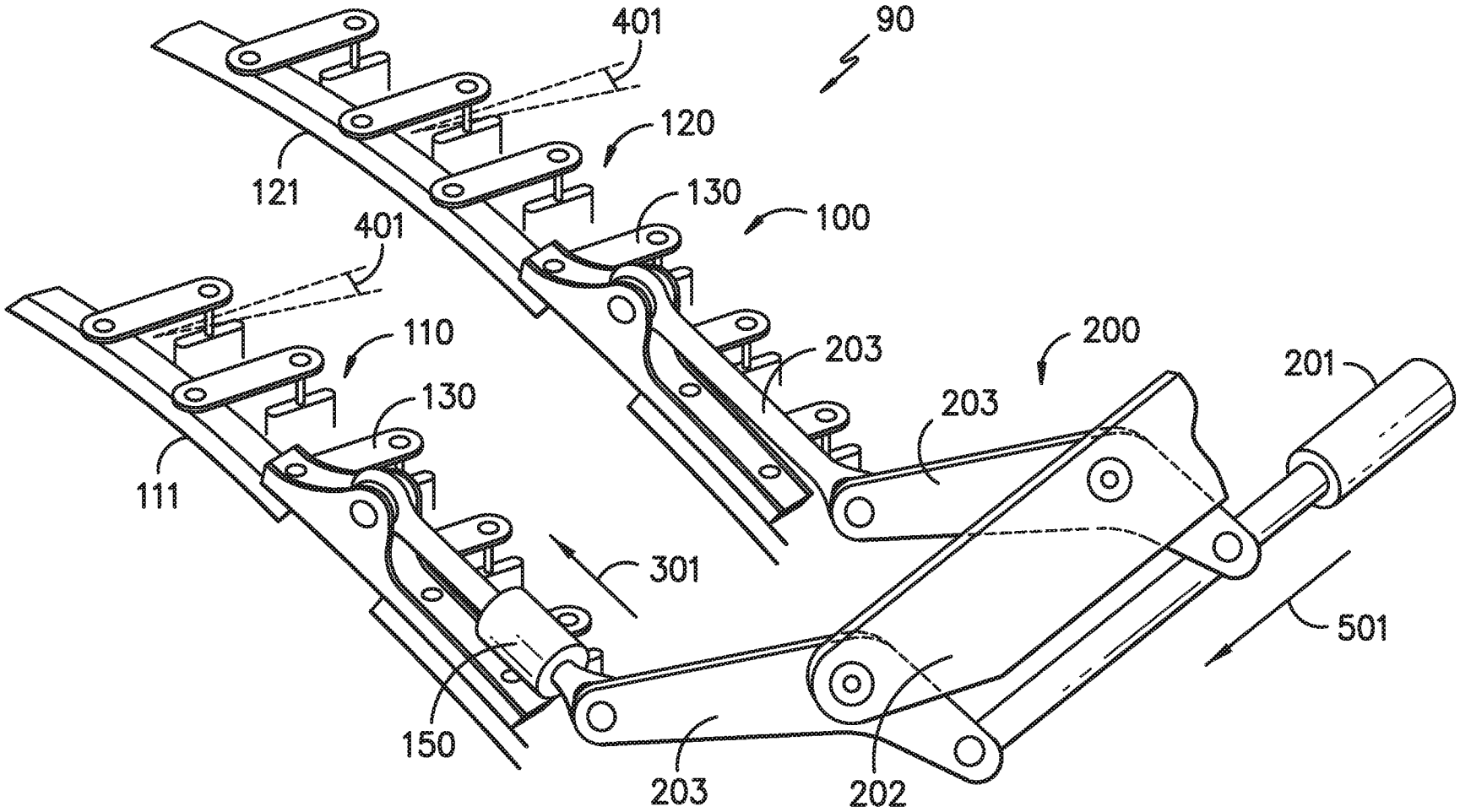
FIGS. 2A-2B are perspective views of an embodiment of portions of a system for operating a turbo machine according to aspects of the present disclosure.
Figure 2B:
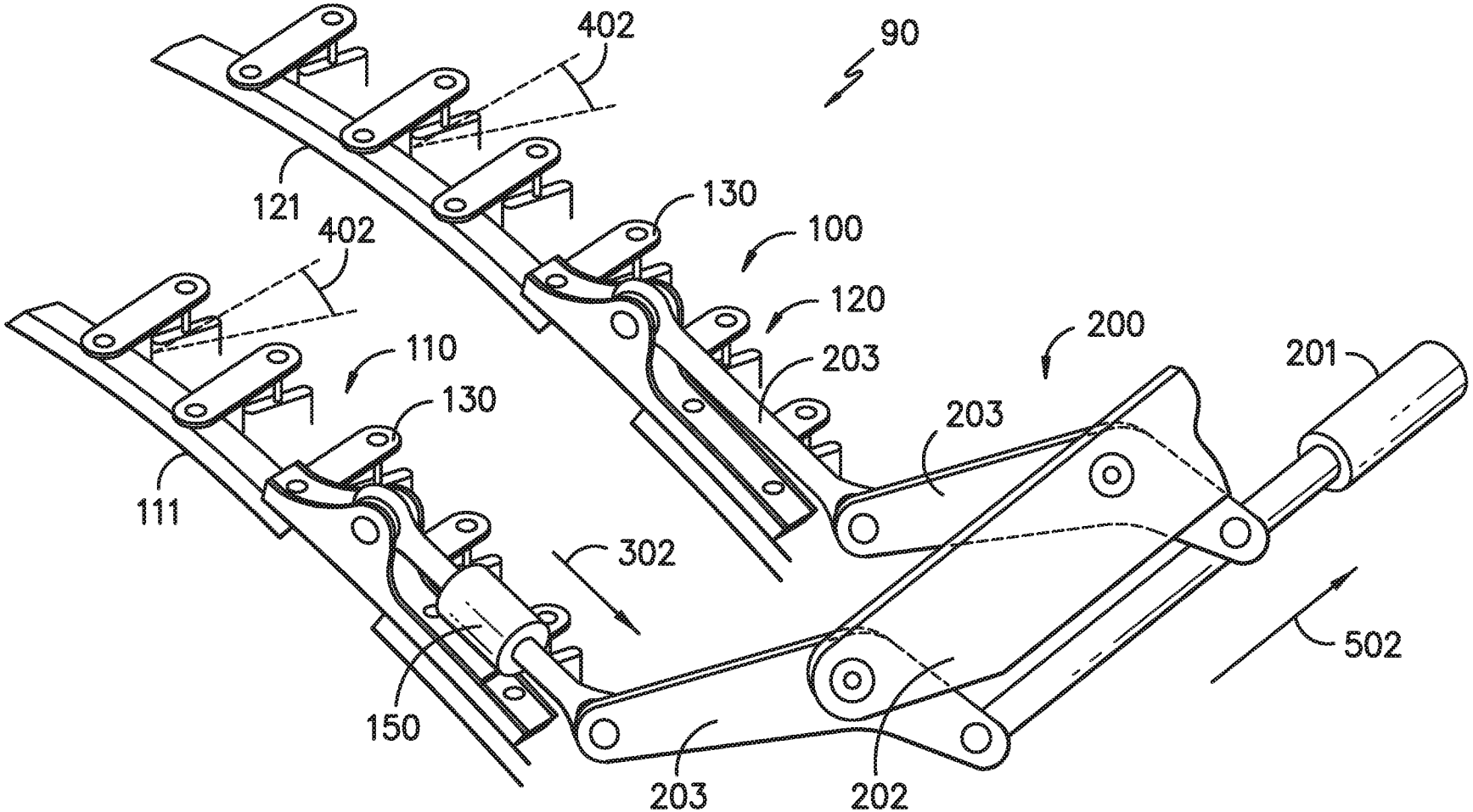
Figure 3A:
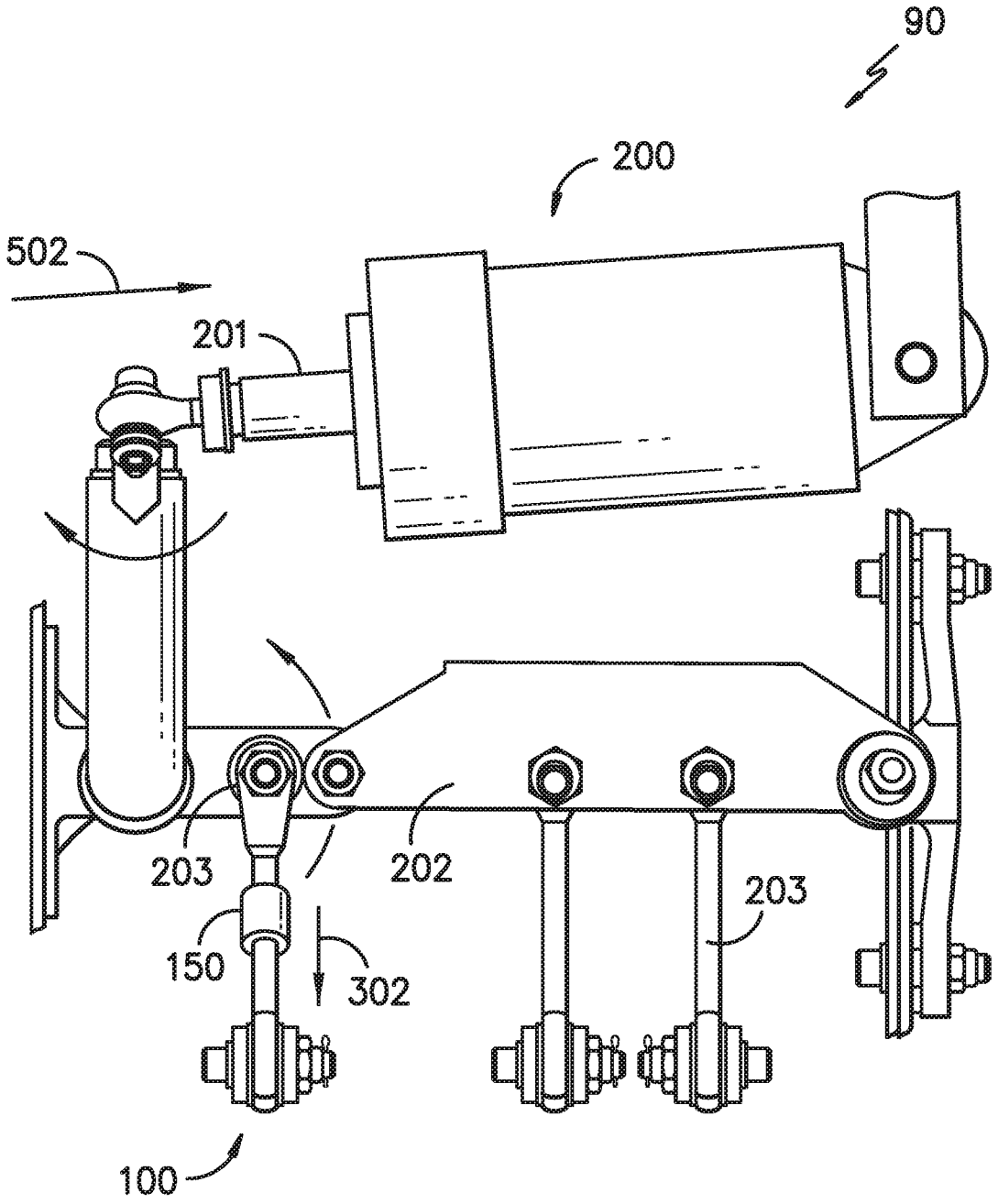
FIGS. 3A-3B are perspective views of another embodiment of portions of a system for operating a turbo machine according to aspects of the present disclosure.
Figure 3B:
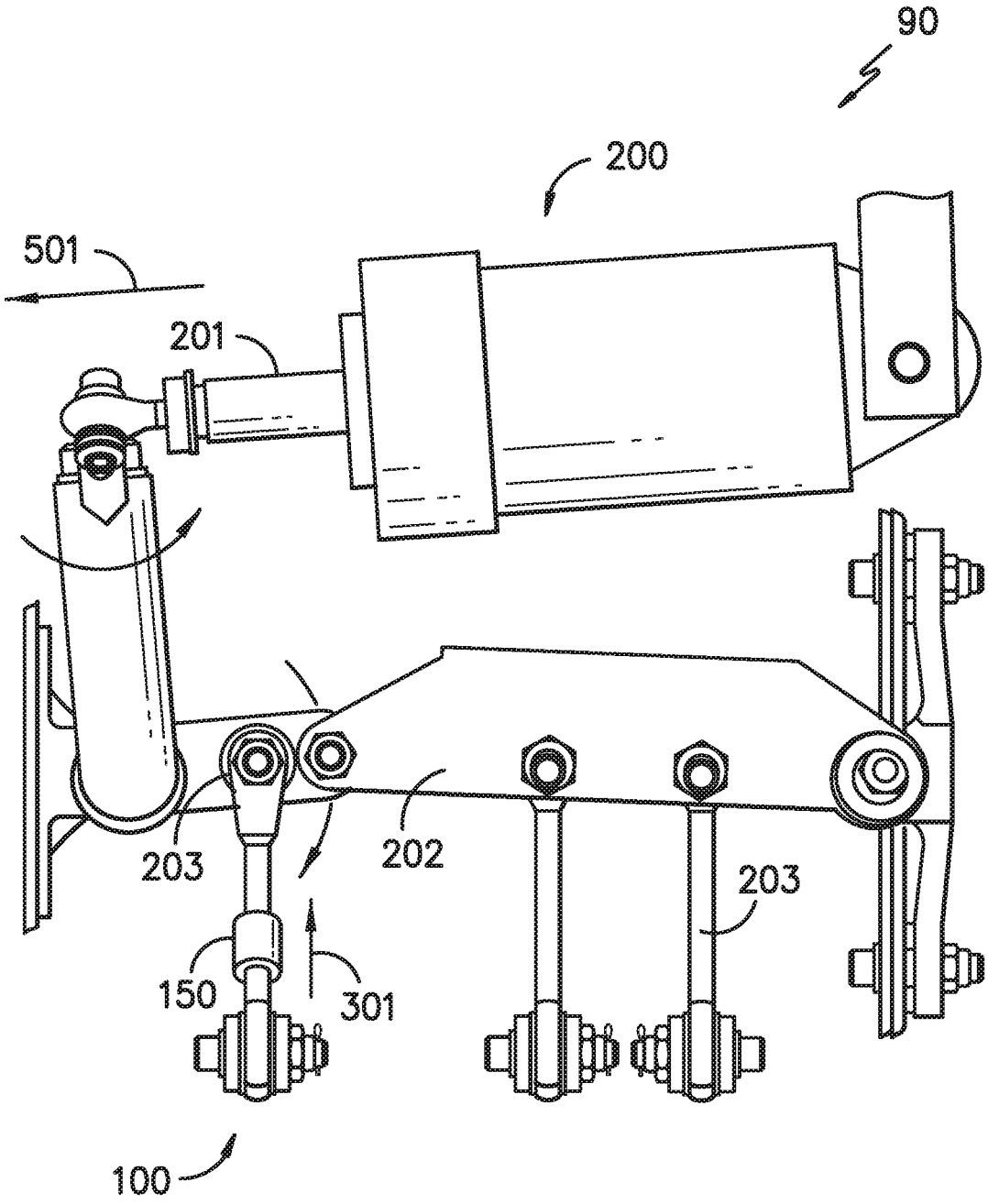

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Approximations recited herein may include margins based on one more measurement devices as used in the art, such as, but not limited to, a percentage of a full scale measurement range of a measurement device or sensor. Alternatively, approximations recited herein may include margins of 10% of an upper limit value greater than the upper limit value or 10% of a lower limit value less than the lower limit value.

Embodiments of a system for independent variable vane actuation for a turbo machine are generally provided. The systems shown and described herein may improve operability or performance of the turbo machine by enabling displacement of a stage of vanes independent of one or more other stages of vanes. Additionally, or alternatively, the system for variable vane actuation may mitigate adverse effects due to changes at a first stage relative to changes at one or more other stages.

Referring now to the drawings, FIG. 1 is a schematic partially cross-sectioned side view of an exemplary turbo machine 10 herein referred to as "engine 10" as may incorporate various embodiments of the present invention. Although generally depicted herein as a gas turbine engine defining a turbofan configuration, the engine 10 shown and described herein may further define a turboprop or turboshaft configuration, such as gas turbine engines for industrial or marine use, or a steam turbine engine. As shown in FIG. 1, the engine 10 has a longitudinal or axial centerline axis 12 that extends there through for reference purposes. In general, the engine 10 may include a fan assembly 14 and a core engine 16 disposed downstream of the fan assembly 14.

The core engine 16 may generally include a substantially tubular outer casing 18 that defines an annular inlet 20. The outer casing 18 encases or at least partially forms, in serial flow relationship, a compressor section 21 having a booster or low pressure (LP) compressor 22, a high pressure (HP) compressor 24, or one or more intermediate pressure (IP) compressors (not shown) disposed aerodynamically between the LP compressor 22 and the HP compressor 24; a combustion section 26; a turbine section 31 including a high pressure (HP) turbine 28, a low pressure (LP) turbine 30, and/or one or more intermediate pressure (IP) turbines (not shown) disposed aerodynamically between the HP turbine 28 and the LP turbine 30; and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. In other embodiments, an IP rotor shaft drivingly connects the IP turbine to the IP compressor (not shown). The LP rotor shaft 36 may also, or alternatively, be connected to a fan shaft 38 of the fan assembly 14. In particular embodiments, such as shown in FIG. 1, the LP shaft 36 may be connected to the fan shaft 38 via a power or reduction gear assembly 40 such as in an indirect-drive or geared-drive configuration.

Combinations of the compressors 22, 24, the turbines 28, 30, and the shafts 34, 36, 38 each define a rotor assembly of the engine 10. For example, in various embodiments, the LP turbine 30, the LP shaft 36, the fan assembly 14 and/or the LP compressor 22 together define the rotor assembly as a low pressure (LP) rotor assembly. The rotor assembly may further include the fan rotor 38 coupled to the fan assembly 14 and the LP shaft 36 via the gear assembly 40. As another example, the HP turbine 28, the HP shaft 34, and the HP compressor 24 may together define the rotor assembly as a high pressure (HP) rotor assembly. It should further be appreciated that the rotor assembly may be defined via a combination of an IP compressor, an IP turbine, and an IP shaft disposed aerodynamically between the LP rotor assembly and the HP rotor assembly.

As shown in FIG. 1, the fan assembly 14 includes a plurality of fan blades 42 that are coupled to and that extend radially outwardly from the fan shaft 38. An annular fan casing or nacelle 44 circumferentially surrounds the fan assembly 14 and/or at least a portion of the core engine 16. It should be appreciated by those of ordinary skill in the art that the nacelle 44 may be configured to be supported relative to the core engine 16 by a plurality of circumferentially-spaced outlet guide vanes or struts 46. Moreover, at least a portion of the nacelle 44 may extend over an outer portion of the core engine 16 so as to define a bypass airflow passage 48 therebetween.

During operation of the engine 10, a volume of air as indicated schematically by arrows 74 enters the engine 10 through an associated inlet 76 of the nacelle 44 and/or fan assembly 14. As the air 74 passes across the fan blades 42 a portion of the air as indicated schematically by arrows 78 is directed or routed into the bypass airflow passage 48, through which most propulsive thrust is generally generated, while another portion of the air as indicated schematically by arrow 80 is directed or routed into the LP compressor 22. Air 80 is progressively compressed as it flows through the LP and HP compressors 22, 24 towards the combustion section 26.

Referring still to FIG. 1, the combustion gases 86 generated in the combustion section 26 flows to the HP turbine 28 of the turbine section 31, thus causing the HP shaft 34 to rotate, thereby supporting operation of the HP compressor 24. As shown in FIG. 1, the combustion gases 86 are then routed to the LP turbine 30, thus causing the LP shaft 36 to rotate, thereby supporting operation of the LP compressor 22 and rotation of the fan shaft 38. The combustion gases 86 are then exhausted through the jet exhaust nozzle section 32 of the core engine 16 to provide propulsive thrust.

As operation of the engine 10 transitions from rest or zero RPM to startup and ignition, a minimum steady state operating condition (i.e., minimum steady state air and fuel flow through the core engine 16 to sustain approximately zero acceleration), a maximum steady state operating condition (i.e., maximum steady state air and fuel flow through the core engine 16 to sustain approximately zero acceleration), or one or more intermediate steady state operating conditions therebetween, a variable vane assembly 100 at the engine 10 adjusts an angle of attack or a rotational angle 401, 402 of axially separated stages of vanes (e.g., a first plurality of vanes 110 and a second plurality of vanes 120 shown and described in regard to FIGS. 2A-2B and FIGS. 3A-3B).

Although the variable vane assembly 100 may generally be shown and described below in regard to adjusting the angle of attack or rotational angle 401, 402 of vanes 110, 120 (FIGS. 2A-2B and FIGS. 3A-3B) disposed at the compressor section 21, it should be appreciated that embodiments of the variable vane assembly shown and described herein may be disposed at the turbine section 31 and/or the fan section 14 in substantially similar configuration.

Referring now to FIGS. 2A-2B and FIGS. 3A-3B, perspective views of exemplary embodiments of a system 90 for operating the variable vane assembly 100 is generally provided. The variable vane assembly 100 includes a first plurality of vanes 110 disposed upstream of a first rotor. The variable vane assembly 100 further includes a second plurality of vanes 120 disposed downstream of the first rotor. The first rotor may generally define a rotary structure of the engine 10 at the compressor section 21, the turbine section 31, the fan section 14, or elsewhere. The first plurality of vanes 110 are coupled together via a first unison member 111. The second plurality of vanes 120 are coupled together via a second unison member 121. The plurality of vanes 110, 120 are each coupled to their respective unison members 111, 121 via an arm 130.

The system 90 further includes an actuation system 200 coupled to each of the first unison member 111 and the second unison member 121 of the variable vane assembly 100. The actuation system 200 may generally include an actuator 201 providing an extending or retracting force. The actuator 201 may define a linear variable differential actuation member providing the extending or retracting force along a substantially linear direction. However, in other embodiments, the actuator 201 may provide a rotary force that further translates the unison members 111, 121.

The actuation system 200 further includes a coupling member 202 to which the actuator 201 is coupled. The coupling member 202 is generally attached to each of the first unison member 111 and the second unison member 121. The coupling member 202 may generally include one or more other mechanical linkages 203 (e.g., arms, bushings, linkages, mechanical fasteners, etc.) enabling transfer of the force from the actuator 201 to each of the first unison member 111 and the second unison member 121. For example, the mechanical linkages 203 may generally enable transfer of a substantially linear force from the actuator 201 to enable the unison members 111, 121 to translate tangentially or at least partially circumferentially around the engine 10 such as to rotate the pluralities of vanes 110, 120.

Various embodiments of the system 90 may define at least a portion of the actuation system 200, or more particularly the coupling member 202, as a torque shaft assembly, a bellcrank assembly, a pump handle assembly, or combinations thereof.

The system 90 further includes a solenoid actuator 150 coupled to the variable vane assembly 100 and the actuation system 200. In one embodiment, the solenoid actuator 150 is coupled to one or more of the unison members 111, 121 and the actuation system 200. In another embodiment, the solenoid actuator 150 is coupled to the coupling member 202 of the actuation system 200 and the variable vane assembly 100. The solenoid actuator 150 provides an extending or retracting force to the one of the unison members 111, 121 independent of the actuation system 200. For example, in various embodiments, the solenoid actuator 150 is coupled to the coupling member 202 and the first unison member 111. In other embodiments, the solenoid actuator 150 is coupled to the coupling member 202 and the second unison member 121.

In various embodiments, a single solenoid actuator 150 is coupled to a single stage (e.g., via the first unison member 111) of the engine 10, such that the solenoid actuator 150 provides movement or adjustment of the first plurality of vanes 110 independent of movement of the second plurality of vanes 120. Alternatively, the single solenoid actuator 150 coupled to the second unison member 121 provides movement or adjustment of the second plurality of vanes 120 independent of movement of the first plurality of vanes 110. For example, the single solenoid actuator 150 at each single stage enables movement or displacement of the first plurality of vanes 110 to change the rotational angle of the first plurality of vanes 110 independent of movement or displacement of the actuation system 200 and the second plurality of vanes 120. Additionally, or alternatively, the single solenoid actuator 150 enables movement or displacement of the second plurality of vanes 120 to change the rotational angle of the second plurality of vanes 120 independent of movement or displacement of the actuation system 200 and the first plurality of vanes 110.

As another example, the system 90 may include the solenoid actuator 150 defining a proportional solenoid actuator offsetting movement or displacement from the actuation system 200. For example, movement or displacement of the actuator 201 and the coupling member 202 of the actuation system 200 generally affects the rotational angle of all of the first and second pluralities of vanes 110, 120. The solenoid actuator 200 may adjust or displace substantially simultaneously as the actuation system 200 such as to offset the change in rotational angle at the first plurality of vanes 110 due to the actuation system 200. As such, the solenoid actuator 150 may enable the actuation system 200 to displace while resulting in no change in rotational angle at the first plurality of vanes 200. Alternatively, the solenoid actuator 150 may enable the actuation system 200 to displace while resulting in a nonlinear or non-proportional change in rotational angle at the first plurality of vanes 200 relative to the change in position via the actuation system 200.

As such, during operation of the engine 10, movement from the solenoid actuator 150 adjusts disposition of the unison member 111, 121 in addition to movement from the actuation system 200. Such additional movement from the solenoid actuator 150 enables substantially independent movement of the single stage to which the solenoid actuator 150 is coupled relative to the collective movement of the unison members 111, 121 via the actuation system 200.

In one embodiment, such as generally provided in regard to FIGS. 2A-2B and FIGS. 3A-3B, the solenoid actuator 150 may define a stepwise or two-position (e.g., push/pull) solenoid actuator providing displacement to a first position 301 (FIGS. 2A and 3A) and a second position 302 (FIGS. 2B and 3B) different from the first position 301. For example, the first position 301 may define a nominal position and the second position 302 may define a displaced position (e.g., extended or retracted from nominal). As such, the solenoid actuator 150 may adjust or displace the first plurality of vanes 110 from a first rotational angle 401 (FIG. 2A) corresponding to the first position 301 of the solenoid actuator 150 to a second rotational angle 402 (FIG. 2B) corresponding to the second position 302 of the solenoid actuator 150 independent of movement (or, alternatively, without movement) from the actuation system 200.

Stated alternatively, where the first plurality of vanes 110 and the second plurality of vanes 120 each define the first rotational angle 401, the solenoid actuator 150 enables movement of the first plurality of vanes 110 to the second rotational angle 402 while the second plurality of vanes 120 remains in the first rotational angle 401.

It should be appreciated that the first rotational angle 401 may define different quantitative angular positions at the first plurality of vanes 110 versus the second plurality of vanes 120. For example, the first plurality of vanes 110 defines the first rotational angle 401 as X and the second plurality of vanes 120 defines the first rotational angle 401 as Y. However, it should be understood that the second rotational angle 402 defines a different quantitative angular position at each of the first plurality of vanes 110 and the second plurality of vanes 120. For example, the first plurality of vanes 110 defines the second rotational angle 402 as X' different from X and the second plurality of vanes 120 defines the second rotational angle 402 as Y' different from Y. As such, the solenoid actuator 150 enables the first plurality of vanes 110 to define the second rotational angle X' while the second plurality of vanes 120 defines the first rotational angle Y.

Furthermore, movement or adjustment from the actuation system 200 (e.g., via the actuator 201, depicted by arrows 501 and 502) enables the plurality of vanes 110, 120 to define the second rotational angle 402 (e.g., X' and Y'). The solenoid actuator 150 may further enable the first plurality of vanes 110 to define the first rotational angle 401 (e.g., X) while the second plurality of vanes defines the second rotational angle 402 (e.g., Y').

In another embodiment, the solenoid actuator 150 defines a proportional actuator providing extension or retraction to/from a plurality of positions. For example, the solenoid actuator 150 defining the proportional actuator may define a plurality of positions including a full extend position, a full retract position, and a plurality of intermediate positions therebetween. The solenoid actuator 150 defining the proportional actuator may define the plurality of positions based on an input signal further described below in regard to a controller 210 (FIG. 1) included in the system 90.

Embodiments of the system 90 including the solenoid actuator 150 coupled between the actuation system 200 and the variable vane assembly 100 enables nonlinear changes in the first plurality of vanes 110 relative to changes in the second plurality of vanes 120. For example, as the actuation system 200 provides linear displacement translated to the unison members 111, 121 and ultimately the variable vanes 110, 120, the solenoid actuator 150 enables nonlinear changes in the first plurality of vanes 110 via independent displacement relative to the actuation system 200 and the second plurality of vanes 120.

It should be appreciated that although the embodiments described herein include the solenoid actuator 150 coupled to the first plurality of vanes 110 operating substantially independent of the actuation system 200, the solenoid actuator 150 may additionally, or alternatively, be coupled to the second plurality of vanes 120 such as to operate substantially independent of the actuation system 200 and/or the first plurality of vanes 110. Still further, although the foregoing has described a first plurality of vanes 110 and a second plurality of vanes 120, it should be appreciated that the engine 10 may include additional pluralities of vanes (e.g., additional pluralities of the second vanes 120) coupled together via the actuation system 200, such as to define three or more stages of variable vanes.

Referring back to FIG. 1, in conjunction with FIGS. 2A-2B and FIGS. 3A-3B, the controller 210 can generally correspond to any suitable processor-based device, including one or more computing devices. For instance, FIG. 1 illustrates one embodiment of suitable components that can be included within the controller 210. As shown in FIG. 1, the controller 210 can include a processor 212 and associated memory 214 configured to perform a variety of computer-implemented functions. In various embodiments, the controller 210 may be configured to operate the system 90 such as to provide a signal to the solenoid actuator 150 commanding extension or retraction (e.g., to one or more positions such as described in regard to FIGS. 2A-2B and FIGS. 3A-3B).

As used herein, the term "processor" refers not only to integrated circuits referred to in the art as being included in a computer, but also refers to a controller, microcontroller, a microcomputer, a programmable logic controller (PLC), an application specific integrated circuit (ASIC), a Field Programmable Gate Array (FPGA), and other programmable circuits. Additionally, the memory 214 can generally include memory element(s) including, but not limited to, computer readable medium (e.g., random access memory (RAM)), computer readable non-volatile medium (e.g., flash memory), a compact disc-read only memory (CD-ROM), a magneto-optical disk (MOD), a digital versatile disc (DVD) and/or other suitable memory elements or combinations thereof. In various embodiments, the controller 210 may define one or more of a full authority digital engine controller (FADEC), a propeller control unit (PCU), an engine control unit (ECU), or an electronic engine control (EEC).

As shown, the controller 210 may include control logic 216 stored in memory 214. The control logic 216 may include instructions that when executed by the one or more processors 212 cause the one or more processors 212 to perform operations such as extending or retracting the solenoid actuator 150 and/or the actuation system 200 to one or more positions such as described in regard to FIGS. 2A-2B and FIGS. 3A-3B.

Additionally, as shown in FIG. 1, the controller 210 may also include a communications interface module 230. In various embodiments, the communications interface module 230 can include associated electronic circuitry that is used to send and receive data. As such, the communications interface module 230 of the controller 210 can be used to receive data from the system 90 (e.g., the variable vane assembly 100, the solenoid actuator 150, the actuation system 200) providing a rotational position or angle of attack of the vanes 110, 120 or a linear or other position of the solenoid actuator 150 and/or the actuation system 200.

In addition, the communications interface module 230 can also be used to communicate with any other suitable components of the system 90 or the engine 10, such as to receive data or send commands to/from any number of valves, vane assemblies, fuel systems, rotor assemblies, ports, etc. controlling speed, pressure, or flow at the engine 10.

It should be appreciated that the communications interface module 230 can be any combination of suitable wired and/or wireless communications interfaces and, thus, can be communicatively coupled to one or more components of the system 90 via a wired and/or wireless connection. As such, the controller 210 may operate, modulate, or adjust operation of the system 90, acquire or transmit signals via the variable vane assembly 100, the solenoid actuator 150, and/or the actuation system 200.

It should be appreciated that embodiments of the system 90 and engine 10 generally provided herein may enable safe operation of the engine 10 at the plurality of positions to which the solenoid actuator 150 and/or the actuation system 200 may move the plurality of vanes 110, 120. In various embodiments, the system 90 may enable the solenoid actuator 150 to move vanes to provide an operational advantage to the system 90 and engine 10 versus one or more other positions. Exemplary embodiments of the system 90 may enable the solenoid actuator 150 to provide a fail-safe function such as to move the vanes to a safe position for operation of the engine 10, or more particularly the compressor section 21 and/or turbine section 31 (e.g., to avoid one or more adverse operating conditions described herein).

In one exemplary embodiment of operation of the engine 10 including the system 90, the first plurality of vanes 110 may define an inlet guide vane (IGV) or upstream-most stage of the compressor section 21 generally, or an upstream-most stage of the HPC 24 specifically. During operation of the engine 10, the system 90 may adjust the position of the first plurality of vanes 110 via the solenoid actuator 150 independently of movement of the actuation system 200 and the second plurality of vanes 120. For example, as the engine 10 may approach operability limits when accelerating or generally operating from zero RPM to a full load condition (e.g., 100% power output, maximum rotor speed, takeoff condition, etc.), the first plurality of vanes 110 may need to limit or restrict additional airflow into the compressor section 21 (or, more specifically, the HPC 24) such as to avoid adverse operating conditions (e.g., rotating stall, compressor surge, or performance deterioration generally). However, the engine 10 may additionally need to adjust the position of the second plurality of vanes 120 such as to further avoid the adverse operating condition. As the movement of the actuation system 200 may displace the second plurality of vanes 120 to a position (e.g., second rotational angle Y') desirable for avoiding adverse operating conditions, the same position (e.g., second rotational angle X') may be undesirable for the first plurality of vanes 110 to avoid adverse operating conditions relative to other engine operating inputs (e.g., air flow rate, air pressure, air temperature, air density, etc.). As such, the solenoid actuator 150 displaces the first plurality of vanes 110 to a desirable position (e.g., first rotational angle X, or more generally, not X') for avoiding adverse operating conditions while also enabling the actuation system 200 to displace the second plurality of vanes 120 to the desirable position (e.g., second rotational angle Y').

It should be appreciated that although the foregoing has described a first position corresponding to a first rotational angle and a second position corresponding to a second rotational angle, it should be understood that the actuation system 200 may enable displacement to a plurality of positions such as to define a plurality of rotational angles of the plurality of vanes (e.g., a third rotational angle, a fourth rotational angle, etc.). Additionally, the solenoid actuator 150 may enable displacement of the plurality of vanes to one or more rotational angles different from the corresponding rotational angle from the actuation system 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for operating a turbo machine, the system comprising:
   - a variable vane assembly comprising a first plurality of vanes coupled together by a first unison member and a second plurality of vanes coupled together by a second unison member;
   - an actuation system coupled to each of the first unison member and the second unison member; and
   - a solenoid actuator coupled to the variable vane assembly and the actuation system.

2. The system of claim 1, wherein the solenoid actuator is coupled to one or more of the unison members of the variable vane assembly.

3. The system of claim 1, wherein the actuation system comprises a coupling member, wherein the coupling member is coupled to each of the unison members.

4. The system of claim 3, wherein the solenoid actuator is coupled to the coupling member of the actuation system.

5. The system of claim 1, wherein the solenoid actuator is coupled to the first unison member of the variable vane assembly.

6. The system of claim 1, wherein the first plurality of vanes comprises an inlet guide vane.

7. The system of claim 1, wherein the solenoid actuator defines a two-position solenoid actuator.

8. The system of claim 1, wherein the solenoid actuator defines a proportional solenoid actuator.

9. The system of claim 1, the system further comprising:
   - a controller configured to perform operations, the operations comprising:
   - displacing the first plurality of vanes from a first rotational angle corresponding to a first position of the solenoid actuator to a second rotational angle corresponding to a second position of the solenoid actuator independent of movement from the actuation system.

10. The system of claim 9, the operations further comprising:

offsetting a change in rotational angle at the first plurality of vanes from the actuation system via displacing the solenoid actuator.

11. The system of claim 9, the operations further comprising:

displacing the first plurality of vanes and the second plurality of vanes via the actuation system.

12. The system of claim 9, the operations further comprising:

adjusting the rotational angle of the plurality of vanes via the solenoid actuator at one or more operating conditions of the turbo machine between zero revolutions per minute and maximum steady state operating condition.

13. A turbo machine engine, the engine comprising:

a compressor section;

a turbine section;

a variable vane assembly comprising a first plurality of vanes coupled together by a first unison member and a second plurality of vanes coupled together by a second unison member;

an actuation system coupled to each of the first unison member and the second unison member; and a solenoid actuator coupled to the variable vane assembly and the actuation system.

14. The engine of claim 13, wherein the solenoid actuator is coupled to one or more of the unison members of the variable vane assembly.

15. The engine of claim 13, wherein the actuation system comprises a coupling member, wherein the coupling member is coupled to each of the unison members.

16. The engine of claim 15, wherein the solenoid actuator is coupled to the coupling member of the actuation system.

17. The engine of claim 13, wherein the solenoid actuator is coupled to the first unison member of the variable vane assembly.

18. The engine of claim 13, wherein the first plurality of vanes comprises an upstream-most stage of the compressor section.

19. The engine of claim 13, wherein the first plurality of vanes comprises an inlet guide vane of a high pressure compressor of the compressor section.

20. The engine of claim 13, wherein the variable vane assembly, the actuation system, and the solenoid actuator are coupled to the turbine section.

* * * * *